United States Patent [19]

Pasic

[11] Patent Number: 4,473,005

[45] Date of Patent: Sep. 25, 1984

[54] APPARATUS FOR STRAPPING UNSTABLE STACKS OF MAGAZINES AND THE LIKE

[75] Inventor: James A. Pasic, Grays Harbor County, Wash.

[73] Assignee: Ovalstrapping, Inc., Hoquiam, Wash.

[21] Appl. No.: 410,631

[22] Filed: Aug. 23, 1982

[51] Int. Cl.[3] ..... B65B 13/20

[52] U.S. Cl. ..... 100/7; 100/3; 100/26

[58] Field of Search ..... 100/2, 3, 7, 26; 53/529

[56] References Cited

U.S. PATENT DOCUMENTS

| | | | |
|---|---|---|---|
| 2,630,750 | 3/1953 | Eberle | 100/7 X |
| 2,684,626 | 7/1954 | Eberle | 100/7 X |
| 2,867,166 | 1/1959 | Saxton | 100/7 X |
| 3,735,555 | 5/1973 | Pasic | 53/529 |
| 3,884,139 | 5/1975 | Pasic | 100/26 |
| 4,090,441 | 5/1978 | Muller | 100/7 |
| 4,120,239 | 10/1978 | Pasic | 100/26 |
| 4,196,663 | 4/1980 | Pasic | 100/7 |
| 4,201,127 | 5/1980 | Pasic | 100/7 |
| 4,312,266 | 1/1982 | Pasic | 100/7 |

*Primary Examiner*—Billy J. Wilhite

*Attorney, Agent, or Firm*—Seed and Berry

[57] ABSTRACT

A strapping machine particularly adapted for strapping unstable stacks of magazines and the like includes a means for positive pushing of the unstable stack into position at the strapping station by sliding the stack over a surface having a low coefficient of friction. At the strapping station, a compactor compresses the stack and a strap is automatically applied around the stack. Then, a pusher bar moves to contact the rearward end of the stack and to remove the strapped stack from the strapping station. Bundle stops which are used to properly position the unstrapped stack in the strapping station are mechanically linked to the pusher bar to retract when the pusher bar is used to move the strapped bundle from the strapping station. These bundle stops automatically reposition themselves so that this machine is ready to receive another unstrapped stack.

12 Claims, 9 Drawing Figures

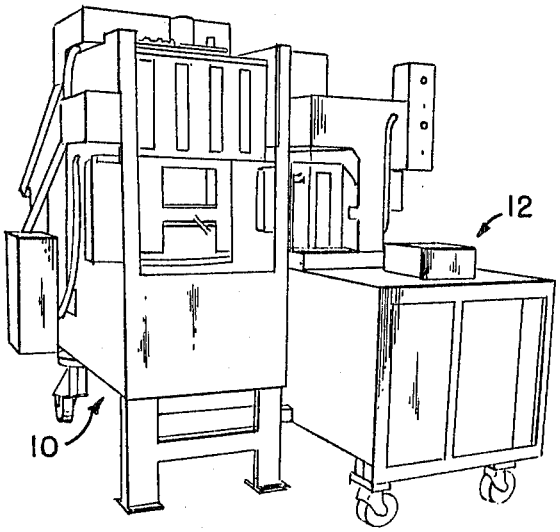
FIG. 1
FIG. 2
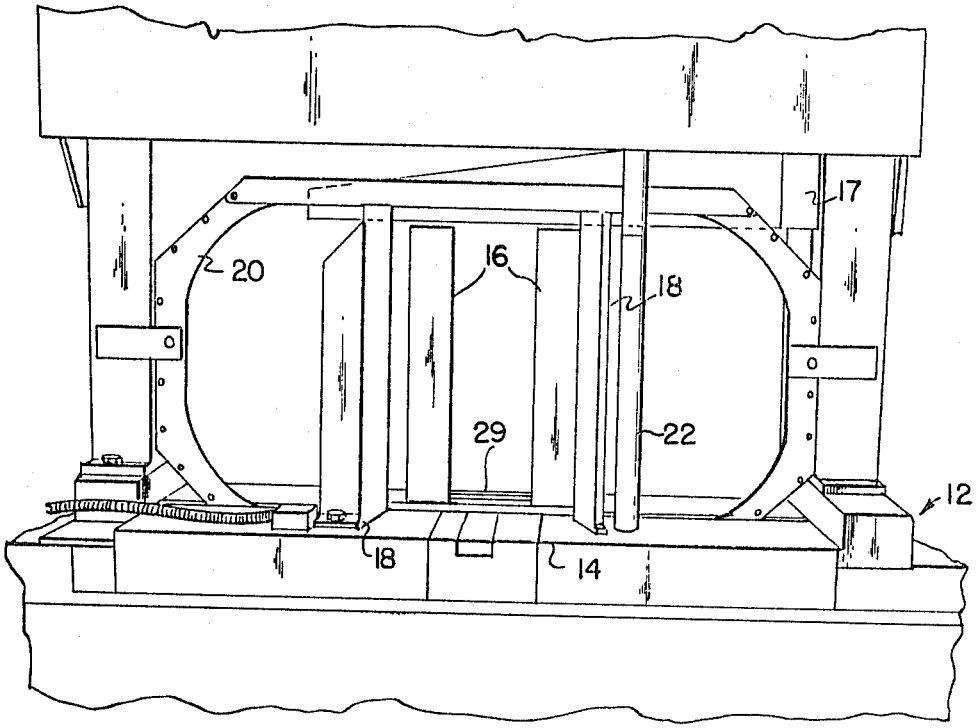

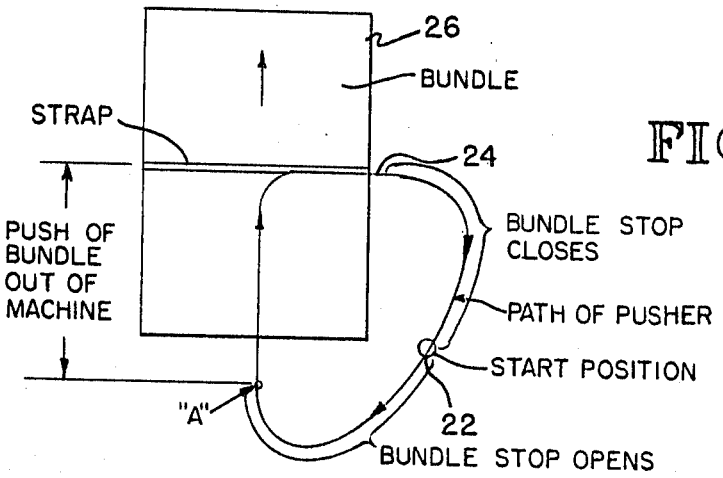
FIG. 3
FIG. 4
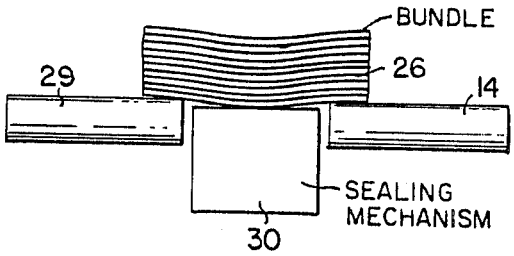
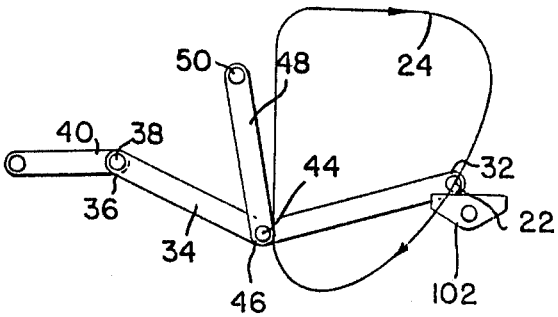
FIG. 5

APPARATUS FOR STRAPPING UNSTABLE STACKS OF MAGAZINES AND THE LIKE

DESCRIPTION

1. Technical Field

The present invention relates to high-speed, automatic strapping machines particularly adapted to strap stacks of magazines and the like.

2. Background Art

Many high-speed, automatic strapping machines have been developed. Representative machines are disclosed in the following U.S. Pat. Nos.: 3,735,555; 3,884,139; 4,120,239; 4,312,266; 4,196,663; and 4,201,127. (These patents are incorporated be reference into this description.)

As can be seen by the patented devices, a conveyor belt is generally used to convey the bundle at high speed to a strapping station where straps are automatically applied before a conveyor belt moves the strapped bundle away from the machine. When strapping unstable stacks of magazines and the like, conveyor belts are undesirable. The quality of paper in magazines makes them slippery, and use of conveyor belts causes the bundles to tumble prior to reaching the strapping station. The strapping operation is greatly slowed. While between 60–80 bundles/minute may be strapped if newspapers are used, a considerably lower number of magazine bundles may be strapped because of the collapse of the bundles. If the integrity of the bundle could be maintained by eliminating the use of belts or roller conveyors, the speed and dependability of strapping of magazines or other unstable bundles could be greatly increased.

Many attempts have been made to stabilize these stacks. These solutions include various types of guides and fences to keep the stack intact. None of the methods is particularly desirable or particularly efficient.

Conveyor belts pose another problem for conveying these unstable bundles. Once a stack of magazines, for example, has been strapped, it is difficult for a conveyor belt to pick up the strapped bundle because of the small dimensions of a magazine bundle in contrast to the dimensions of ordinary newsprint. Removal of the bundle from the machine is slowed. The conveyor belts wear rapidly. Therefore, elimination of the conveyor belt for removal of the strapped bundle from the strapping station would be desirable, especially if bundles of small magazines are to be handled quickly and efficiently.

DISCLOSURE OF INVENTION

The present invention relates to an apparatus and method for strapping unstable bundles of magazines and the like. Normally, the strapping machine is placed immediately adjacent to a stacker. A bundle of unstable magazines is formed in the stacker and is pushed into the strapping station of the strapping machine directly by a pusher on the stacker. The magazine stack slides across a surface which has a low coefficient of friction. In this manner, belt or roller conveyors are eliminated and the integrity of the stack is usually maintained because a pusher is used. Guides are positioned at the sides of the stack to better ensure that the stack remains intact as the stack enters the strapping station. Bundle stops are positioned to stop the forward movement of the stack so that the pusher properly positions the unstable stack at the strapping station.

Once properly positioned at the strapping station, the stack is automatically strapped and the strapped bundle is pushed from the strapping station by a mechanical pusher bar which moves to contact the rearward portion of the stack and to slide the strapped bundle forward across another surface having a low coefficient of friction. This pusher bar concept overcomes the problem associated with conveyor belts used to transport the strapped bundle from the strapping station.

The pusher bar which removes the strapped bundle from the strapping station and the bundle stops which are necessary for proper placement of the unstrapped bundle in the strapping station are mechanically coupled so that movement of the pusher bar automatically actuates the retraction of the bundle stops. As the pusher bar approaches its starting position, the bundle stops automatically reposition themselves for receipt of another unstrapped, unstable stack.

Therefore, through a positive pushing mechanism, an unstable stack of magazines and the like is directly conveyed from a stacker to a strapping station and is quickly and efficiently strapped and conveyed from the strapping station. No belts or moving conveyors are used. This apparatus and method have proven to be a satisfactory manner of strapping unstable stacks of magazines and the like. Relatively high speeds may be achieved with the "pusher" concept of this apparatus, thereby greatly improving the strapping operation.

BRIEF DESCRIPTION OF THE DRAWINGS

FIG. 1 shows a general schematic overview of a stacker positioned adjacent to a strapping machine of this invention.

FIG. 2 shows schematically the entry view of the strapping machine of FIG. 1.

FIG. 3 is a schematic representation of the path of the pusher bar used to push a strapped stack from a strapping station.

FIG. 4 is a schematic representation of an unstrapped bundled positioned at the strapping station.

FIG. 5 is a schematic representation of a preferred four-bar linkage designed to produce the desired motion of the pusher bar.

BEST MODE FOR CARRYING OUT THE INVENTION

Figure 6:
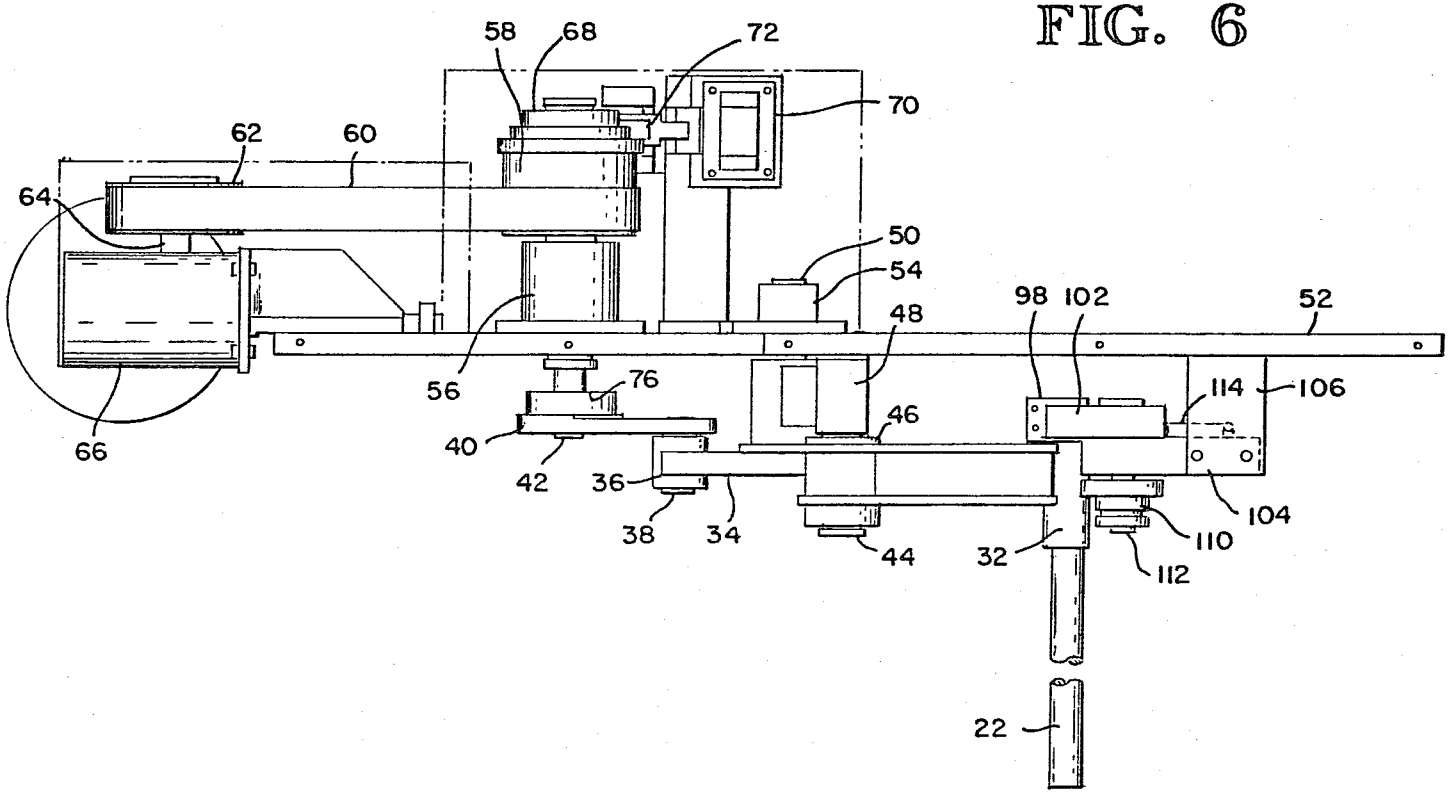
FIG. 6 is a detailed side elevation of a pusher mechanism of this invention.

As shown in FIG. 1, a Rima stacker 10 is positioned directly adjacent to the strapping machine 12 of the present invention. The stacker 10 receives magazines fed serially to a bucket. As a predetermined number of magazines has been added to the bucket, the stack drops from the bucket and is positioned on a turntable. The bucket returns to receive additional magazines, and the turntable turns the partial bundle 180 degrees. A second partial stack of magazines drops down onto the stack already formed on the turntable so that magazine bindings are alternating. At a predetermined point in the stacking, a positive pusher moves against the rearward portion of the stack of magazines on the turntable and pushes the magazine stack forward out of the stacker. This stacker operation is conventional and is generally known.

As shown in FIG. 2, with the stacker 10 directly adjacent to the strapping machine 12, the stack of magazines is pushed across a surface 14 which has a low coefficient of friction into the strapping station of the strapping machine 12. (For purposes of this description, "low coefficient of friction" shall mean a surface polished enough to allow sliding of the unstable stack of magazines and the like easily across the surface into a predetermined position without substantial disruption of the integrity of the stack.) The pusher bar of the stacker 10 continues to push the stack forward until the stack abuts downwardly-depending, spaced bundle stops 16 which are positioned at a predetermined location to properly position the stack within the strapping station. Stack guides 18 are positioned along opposite sides of the stack to further guide the stack from the stacker 10 into the strapping station.

At the strapping station, a strap is cinched around the stack by passing the strap through the strap guide 20 in a conventional manner, as described in U.S. Pat. No. 4,120,239 (incorporated by reference into this description).

As the bundle enters the strapping station, the bundle breaks a photolight which activates the strapping cycle. Usually, a compactor 17 of the type shown either in U.S. Pat. No. 4,196,663 or U.S. Pat. No. 4,201,127 (incorporated by reference into this description) moves downwardly to compact the stack. Once the bundle is compacted, a strap is applied. When the strapping operation is complete, the compactor 17 starts its upward movement to its home position and the pusher bar is activated to begin its motion to remove the strapped bundle from the strapping station. As shown in FIGS. 2 and 3, the pusher bar 22 is initially positioned at the rearward, right edge of the stack of magazines. Once actuated, the pusher bar 22 proceeds clockwise in a generally D-shaped or circular path 24 to contact the strapped stack 26 generally at the longitudinal centerline of the stack 26 to positively push the stack 26 forward out of the strapping station.

As the pusher bar 22 moves from its start position to point A, the mechanical coupling of the pusher bar 22 to the bundle stops (not shown) in FIG. 3 automatically retracts the bundle stops so that the stack 26 may be pushed from the strapping station. Toward the end of the circuit of the pusher bar 22, the mechanical coupling again automatically closes the bundle stops so that the strapping station and strapping machine 10 are prepared to receive a new stack of magazines.

As shown in schematic side section in FIG. 4, the stack 26 of magazines or the like may only be slightly longer than the sealing mechanism 30 of the strapping machine 12. If conveyor belts were to be used, it would be difficult for the end of the conveyor belt to move the strapped bundle 26 forward from the strapping station. Therefore, it is necessary and desirable in a quick and efficient machine to use an alternative means for removing the strapped bundle 26 from the strapping station. The problem is overcome with a surface 29 having a low coefficient of friction and a positive pusher bar mechanism. With the pusher bar 22, the strapped bundle 26 is pushed forwardly to slide over the outfeed table or surface 29. The high speed desirable for strapping even the most unstable of bundles can be readily achieved with this combination.

Figure 7:
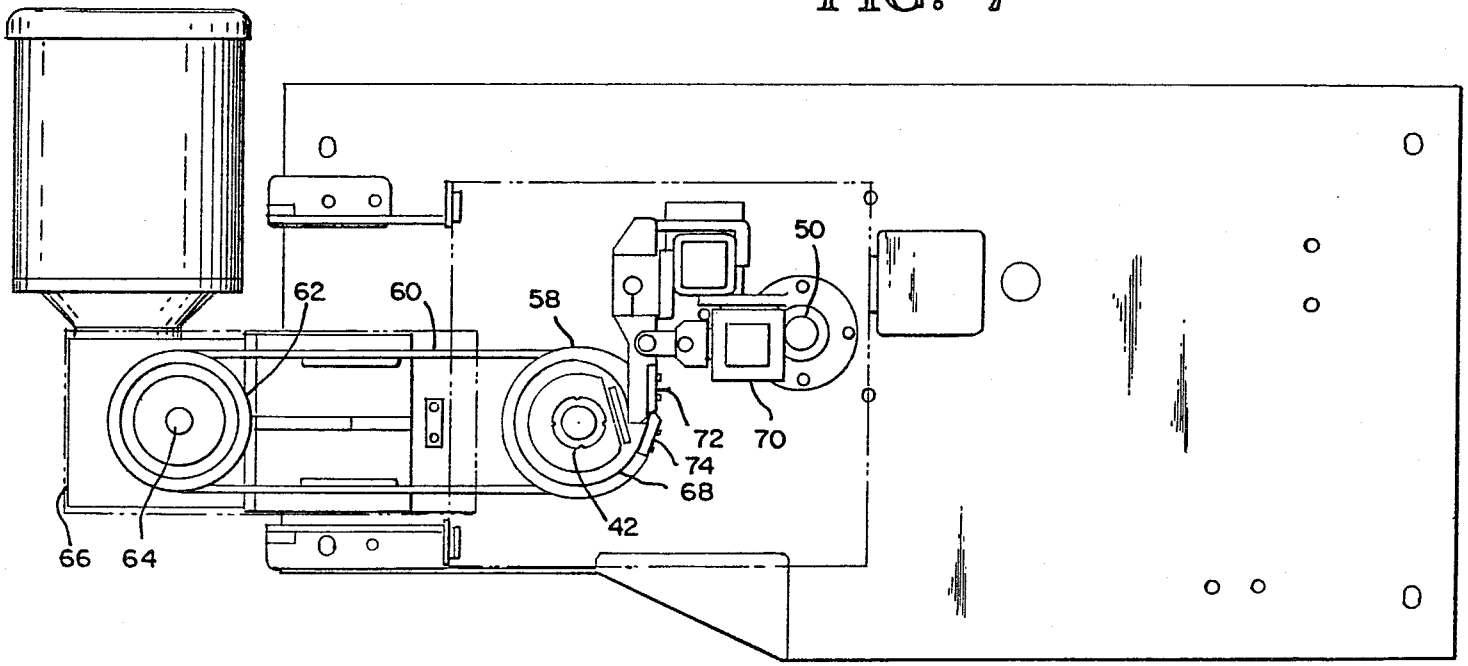
FIG. 7 is a detailed plan view of the mechanism of FIG. 6.

The mechanical means used in a preferred machine to achieve the desired circular path of the pusher bar 22 is shown schematically in FIG. 5 and in detailed side elevation and plan view in FIGS. 6 and 7. The pusher bar 22 is connected to the leading end 32 of an angled four-bar linkage arm 34 which connects at its opposite end 36 through a coupling shaft 38 to a crank arm 40. The crank arm 40 is mounted on a crankshaft 42. A pivot shaft 44 connects the center 46 of the four-bar linkage arm 34 to a rocker link 48. The rocker link 48 is connected at its opposite end to a rocker shaft 50 which projects upwardly through a mounting plate 52 and is connected to the mounting plate 52 through a suitable housing 54. Thus, the pusher bar motion is defined by a four-bar linkage having fixed points at the crankshaft 42 and rocker shaft 50. As the crank 40 revolves around the crankshaft 42, the four-bar linkage arm is constrained to the predetermined motion shown in FIG. 3. The mounting plate 52 is mounted in the strapping machine 12 above the compactor 17 so that the pusher bar 22 is suspended above the infeed table 14 and outfeed surface 29.

As shown in FIG. 6, the crankshaft 42 projects upwardly through the mounting plate 52 through a bearing housing 56 to connect with a single-revolution, solenoid-controlled clutch 58. An outer facing surface of the clutch 58 abuts a drive belt 60 which encircles a drive wheel 62 keyed to the driven shaft 64 of a drive motor 66.

In operation, the motor 66 is constantly running to convey the drive belt 60 around the outer facing surface of the clutch 58. A clutch plate 68 engages the crankshaft 42 when a solenoid 70 is activated to lift trigger 72 away from reset lever 74. In this manner, the clutch plate 68 will allow the crankshaft 42 to revolve substantially 360 degrees before the reset lever 74 reengages the trigger 72 and stops further revolution. The crankshaft 42 turns once to turn the crank 40, thereby moving the pusher bar 22 through one circuit of its path, as defined in FIG. 3.

For clarity of understanding, a cam mechanism which links the pusher bar 22 to the bundle stops 16 has been omitted from FIG. 6. Ordinarily, the cam mechanism detailed in FIG. 8 will be keyed to the crankshaft 42 directly above cam seat 76.

Figures 8, 9:
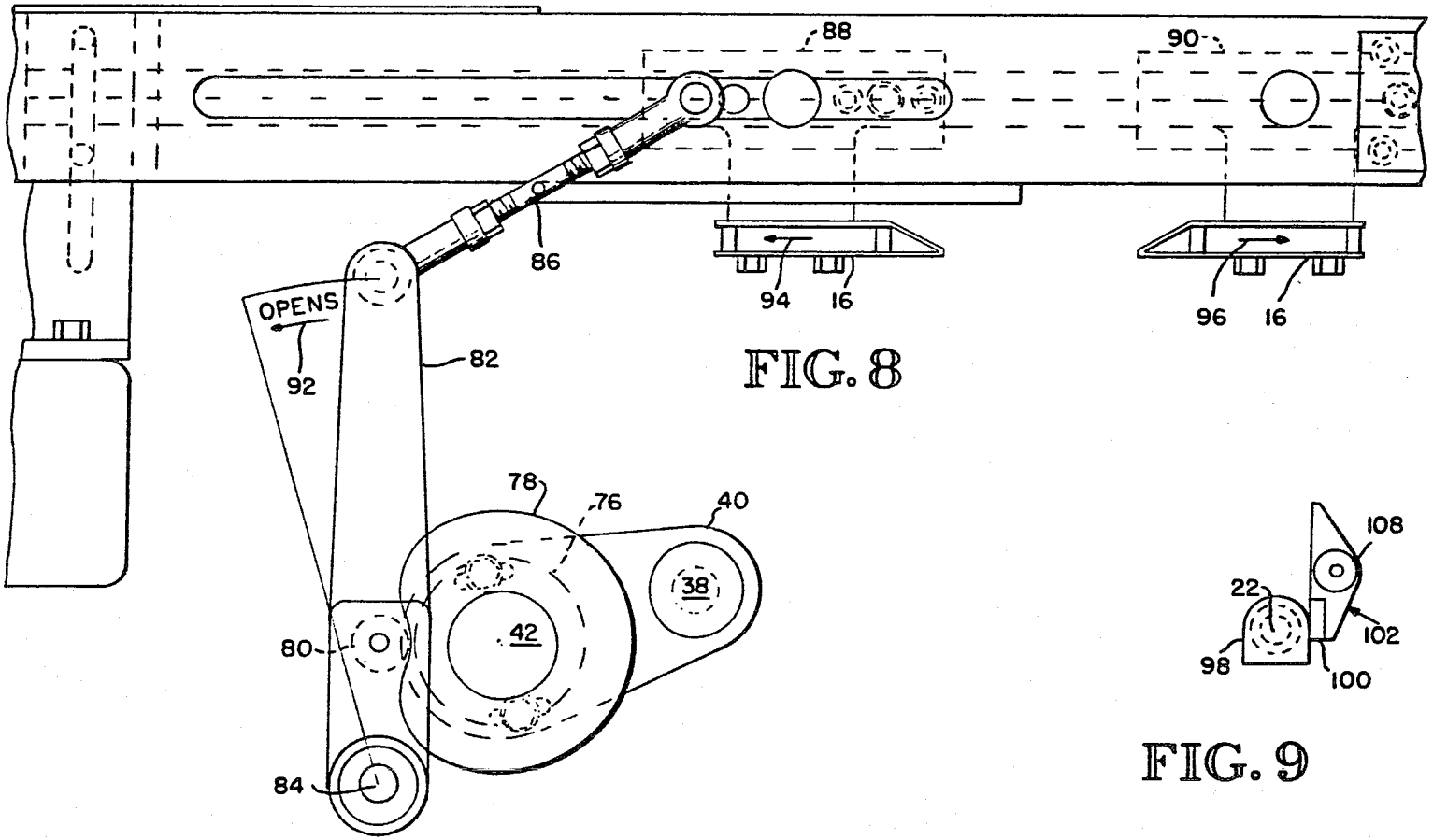
FIG. 8 is a detailed view of a preferred cam system linking the pusher bar to the bundle stops.
FIG. 9 is a schematic plan view of a preferred stopping mechanism to absorb kinetic energy of the pusher bar.

The cam mechanism is best shown by the top plan view of FIG. 8. The kidney-shaped cam 78 rests upon cam seat 76 around crankshaft 42. A cam follower 80 on cam lever 82 is responsive to the shape of the cam 78 to swing the cam lever 82 about pivot 84, thereby moving link 86 to the left or right. The link 86 is connected to a bundle stop carriage 88 from which a bundle stop 16 downwardly depends. The carriage 88 travels in a track on a cable system and is coupled to a slave carriage 90 which holds the other bundle stop 16. Thus, as the cam lever 82 swings counterclockwise, as indicated by arrow 92, carriage 88 is pulled through link 86 to the left (as indicated by arrow 94) while carriage 90 moves to the right (as indicated by arrow 96). In this manner, the bundle stops 16 are cleared from in front of the strapped stack to allow the pusher bar 22 to positively push the bundled stack across the surface 29, thereby removing the strapped stack from the strapping station. The carriage assembly is mounted above the compactor 17 of the strapping machine 12 so that the bundle stops 16 are suspended above the outfeed surface 29 downstream from the strapping station.

Generally, a coiled spring (not shown) connects the two carriages 88 and 90 to ensure that the carriages will automatically retract to their initial position when the cam follower 80 enters the hollow on the kidney-shaped cam 78. In this fashion, the bundle stops 16 are automatically returned to their initial positions, in which they are adapted for receiving another unstrapped stack of magazines.

While a single-revolution clutch 58 is employed to govern the motion of the bundle stops 16 and pusher bar 22, a stopping mechanism (FIGS. 6 and 9) also is associated with the pusher bar 22 to absorb kinetic energy created in moving the pusher bar 22 through its circuitous path. The purpose of this stopping mechanism is to absorb kinetic energy of the moving linkage and to bring it to a controlled stop. A protective sleeve 98 on the top end of the pusher bar 22 engages a bumper 100 on a check plate 102 which is mounted to a horizontal mounting plate 104 that, in turn, is connected to the mounting plate 52 of the main frame. A one-way clutch 108 for the check plate 102 allows free-wheeling in one direction while providing frictional resistance in the other. The amount of friction provided may be adjusted with friction discs 110 through adjustment screw 112, mounted below the mounting plate 104 and keyed to a common, fixed shaft which holds the clutch 108. A spring 114 ensures that the check plate 102 will return to its desired starting position after the check plate 102 is forcibly moved against the friction of the clutch 108 when the crankshaft 42 is turned by the motor 66. When the pusher bar 22 returns from its circuitous path and the single-revolution clutch disengages the motor, the check plate 102 will abosrb the inertial kinetic energy of the pusher 22. Thus the pusher bar 22 will stop at its initial starting position, fully out of the way of the incoming stack of unstrapped magazines or the like.

To provide the low coefficient of friction for the incoming and outgoing surfaces 14 and 29, a chrome-plated sheet metal is used so that the magazines will slide easily into the desired positions.

While preferred embodiments of the invention have been illustrated and described, those skilled in the art will understand that variations and modifications may be made without departing from the general concept and principles of the invention. Accordingly, the invention is intended to be broadly conceptually disclosed, and the claims should not be limited to the specific embodiment illustrated or described unless such limitation is necessary in view of this description and the prior art.

I claim:

1. A strapping machine particularly adapted for strapping unstable stacks of magazines and the like, comprising:

(a) an infeed receiver adapted to receive a stack directly from a stacker so that the stacker positions the stack directly in the strapping machine by sliding the stack over a surface of the receiver which has a low coefficient of friction between the stack and surface;

(b) at least one stop to limit movement of the stack into the strapping machine from the stacker so that the stack is properly positioned for strapping;

(c) a strapper for applying a strap around the stack to bind the stack;

(d) an outfeed table for receiving the strapped stack as the stack leaves the strapper, including a surface which has a low coefficient of friction;

(e) means for retracting the stop after the strap has been affixed to the stack; and (f) at least one pusher for pushing the stack from the machine over the surface of the outfeed table when the stop is retracted, wherein the stop and the pusher are coupled together so that the stop retracts at a predetermined time to allow the pusher to push the stack onto the outfeed table.

2. The strapping machine of claim 1, further comprising guide means spaced on opposite sides of the stack as the stack enters the infeed receiver and contacts the stop to ensure proper positioning of the stack within the machine and adapted to assist in stabilizing the stack prior to strapping of the stack.

3. The strapping machine of claim 1, further comprising a compactor to compress the stack in the strapping machine prior to strapping and adapted to hold the stack compressed during the strapping.

4. The strapping machine of claim 1 wherein the pusher includes a bar connected to a four-bar linkage so that the bar travels in a generally circular path to push the stack from the strapping machine and the linkage is controlled with a single-revolution control means to ensure that the bar revolves only once per stack in the machine.

5. The strapping machine of claim 4 wherein the single-revolution control means includes a drive motor having a driven shaft coupled to a clutch, a single-revolution clutch on a crankshaft to limit the revolution of the crankshaft to one revolution per actuation of the clutch, and means to activate the clutch at predetermined intervals.

6. The strapping machine of claim 5 wherein the stop and pusher are coupled together by a coupling which includes a cam on the crankshaft which retracts the stop each time the crankshaft revolves and which returns the stop to its original position after retracting.

7. The strapping machine of claim 1 wherein the stop includes two blades hanging in spaced relation over the outfeed table at a predetermined position, wherein the blades are adapted to retract to opposite sides of the stack when activated by the means for retracting.

8. A strapping machine particularly adapted for strapping unstable stacks of magazines and the like, comprising:

(a) an infeed receiver adapted to receive a stack directly from a stacker so that the stacker positions the stack directly in the strapping machine by sliding the stack over a surface of the receiver which has a low coefficient of friction between the stack and surface;

(b) at least one stop to limit movement of the stack into the strapping machine from the stacker so that the stack is properly positioned for strapping;

(c) guide means spaced on opposite sides of the stack as the stack enters the infeed receiver and contacts the stop to ensure proper positioning of the stack within the machine and adapted to assist in stabilizing the stack prior to strapping;

(d) a compactor adapted to compress the stack in the strapping machine prior to strapping and adapted to hold the stack compressed during the strapping;

(e) a strapper for applying a strap around the stack to bind the stack;

(f) an outfeed table for receiving the strapped stack as the stack leaves the strapping machine, including a surface which has a low coefficient of friction;

(g) means for retracting the stop after the strap has been affixed to the stack; and (h) at least one pusher for pushing the stack from the machine over the surface of the outfeed table when the stop is retracted, wherein the stop and the pusher are coupled together so that the stop retracts at a predetermined time to allow the pusher to push the stack onto the outfeed table.

9. An apparatus for feeding into and removing from a strapping machine stacks of magazines or other unstable, slippery publications to be strapped, comprising:

low-friction infeed support means upstream of a strapping station for slidably supporting an unstrapped stack of magazines for movement from a stacking apparatus to the strapping station along the infeed section of a predetermined path;

vertical guide means transversely spaced along the path to guide the sides of the stack as the stack is moved along the infeed section of said path;

means at the stacking station for blocking movement of the stack to stop the stack in a desired position in the strapping station;

means movable between said vertical guide means for pushing the strapped stack out of the strapping station along an outfeed section of the predetermined path; and means linking said pushing means with said stack blocking means for bringing said blocking means into said path as the pushing means clears the stacking station, so that the next stack can be fed into the stacking station as the pushing means moves to a position upstream of the strapping station.

10. The apparatus of claim 9, said linking means including mechanical bar means directly connecting together said blocking means and pushing means.

11. The apparatus of claim 9, said linking means including means for moving said pushing means axially along said path through said strapping station, then laterally out of said path downstream of said strapping station and then back to a position upstream of the strapping station.

12. The apparatus of claim 11, said linking means including a first link pivotally supported at a first pivot point along its length, means for oscillating said first pivot point along an arc, means pivotally connected to a second pivot point on said first link for moving said second pivot point in a circle, means connecting said link to a pusher bar at a third point on the opposite side of said link first pivot point from said second pivot point whereby circular movement of second pivot point results in a path of movement of the pusher bar along a straight line axially along said path, thence laterally out of the path downstream of the strapping station, and thence back to a position upstream of the strapping station.

* * * * *